US005960667A

United States Patent [19]

Hylwa et al.

[11] Patent Number: 5,960,667

[45] Date of Patent: Oct. 5, 1999

[54] BALL DEVICE FOR SETTING BLIND RIVERTS

[75] Inventors: William D. Hylwa, Derby; Charles F. Smart, Brookfield; Donald P. Viscio, Danbury, all of Conn.

[73] Assignee: Emhart Inc., Newark, Del.

[21] Appl. No.: 08/996,604

[22] Filed: Dec. 23, 1997

[51] Int. Cl.[6] ..... B21D 9/05

[52] U.S. Cl. ..... 72/391.4; 29/243.521

[58] Field of Search ..... 72/391.4, 391.2, 72/75; 29/243.521–243.525, 243.53; 279/20, 30, 75, 82

[56] References Cited

U.S. PATENT DOCUMENTS

| | | | |
|---|---|---|---|
| 2,150,361 | 3/1939 | Chobert | 72/391.4 |
| 2,275,269 | 3/1942 | O'Loughlin | 279/30 |
| 2,348,611 | 5/1944 | Davidson | 279/22 |
| 2,428,165 | 9/1947 | Ketchum . | |
| 2,569,616 | 10/1951 | Mann . | |
| 2,751,229 | 6/1956 | Schultz | 279/22 |
| 3,109,213 | 11/1963 | O'Sullivan . | |
| 3,254,522 | 6/1966 | Elliott et al. . | |
| 3,302,444 | 2/1967 | Elliott . | |
| 3,334,509 | 8/1967 | Elliott et al. . | |
| 3,491,930 | 1/1970 | Hill . | |
| 3,630,067 | 12/1971 | Henshaw | 72/391 |
| 3,850,021 | 11/1974 | Binns | 72/391 |
| 3,975,032 | 8/1976 | Bent et al. | 279/30 |
| 4,067,403 | 1/1978 | Richmond et al. | 173/163 |
| 4,096,807 | 6/1978 | Woodward | 105/467 |
| 4,237,946 | 12/1980 | Leitner | 81/429 |
| 4,275,893 | 6/1981 | Bilanceri | 279/64 |
| 4,412,764 | 11/1983 | Wawrzyniak | 408/226 |
| 4,506,536 | 3/1985 | Clarke et al. . | |
| 4,517,820 | 5/1985 | Oefinger et al. . | |
| 4,615,475 | 10/1986 | Fuhrmeister . | |
| 4,648,258 | 3/1987 | Frearson . | |
| 4,648,259 | 3/1987 | Pendleton | 72/391 |
| 4,691,552 | 9/1987 | Peterson | 72/391 |
| 4,720,114 | 1/1988 | Braitmaier et al. | 279/2 R |
| 4,799,803 | 1/1989 | Tanaka | 384/43 |
| 4,828,277 | 5/1989 | DeBastiani et al. | 279/1 |
| 5,471,729 | 12/1995 | Zoltaszek . | |
| 5,500,990 | 3/1996 | Wihan . | |

FOREIGN PATENT DOCUMENTS

| | | | |
|---|---|---|---|
| 755410 | 11/1933 | France | 72/391.4 |
| 955740 | 9/1961 | United Kingdom . | |

*Primary Examiner*—Joseph J. Hail, III
*Assistant Examiner*—Ed Tolan
*Attorney, Agent, or Firm*—Edward D. Murphy

[57] ABSTRACT

A ball device for setting blind rivets is provided. The device features one or more rows of balls of at least three balls per row, and a taper section which cooperates with the balls to grip the mandrel of the blind rivet. Upon movement of the taper section, the balls dig into the mandrel to grip, and consequently pull the mandrel in the desired direction. The device features a longer life than similar devices utilizing jaws to grip the mandrel.

26 Claims, 7 Drawing Sheets

BALL DEVICE FOR SETTING BLIND RIVERTS

BACKGROUND OF THE INVENTION

The invention relates to a ball device for setting blind rivets. The device can be utilized in connection with pneumatic, hydraulic or hand operated blind rivet setting tools.

DESCRIPTION OF THE PRIOR ART

Pneumatic or hydraulic power operated and hand operated tools for setting blind rivets are known. Examples of such tools are illustrated in U.S. Pat. Nos. 3,254,522; 3,302,444; 3,334,509; and 4,517,820. Generally, these tools feature a pair of jaws adapted to grip the mandrel of the blind rivet, a jaw guide to force the jaws against the mandrel during the setting operation and a draw bar connected to the jaw guide to pull the jaws and the mandrel so that the mandrel first upsets the rivet body and then is broken off. A serious problem with these type of devices is that of high jaw wear.

Ball one-way slip clutch devices for pulling or advancing wire and ball chuck devices for holding tools or the like are also known. Examples of such devices are illustrated in U.S. Pat. Nos. 2,569,616; 2,109,213; 3,975,032; 4,067,403; 4,275,893; and 4,720,114. These devices merely pull, advance or hold; none of them rupture wire or pull the mandrel of a blind rivet to upset the rivet body and break the mandrel.

Ball devices have been employed in rivet setting tools to advance wire, to cause jaws to pivot and open, to align rivets in a delivery passage and to retain a rivet in the tool prior to setting. Examples of such devices are illustrated in U.S. Pat. Nos. 3,491,930; 4,506,536; 4,615,475; and 4,691,552. Again, none of these devices have set the blind rivet by pulling the mandrel of the blind rivet to upset the rivet body and rupture the mandrel.

SUMMARY OF THE INVENTION

A device for setting blind rivets of the type having a rivet body and a mandrel with a predetermined breakneck extending through the body is provided. The device features at least three balls arranged in one or more rows of at least three balls per row. The balls cooperate with a taper section into which the rivet mandrel extends to grip the mandrel without overcrimping. As the taper section is moved in a direction away from the rivet body, the balls penetrate and grip the mandrel. With continued movement in the same direction, the rivet body is upset and the mandrel broken at the predetermined breakneck. Movement of the taper section is provided by hydraulic, pneumatic, or hand operated mechanism. The ball device does not wear as quickly as prior jaw devices because the balls are free to rotate and the same place on a ball does not always contact the mandrel.

DESCRIPTION OF THE DRAWINGS

FIGS. 11, 12, and 13 are taken along lines 11—11, 12—12, and 13—13 of FIG. 10, respectively.

FIG. 17 is taken along line 17—17 of FIG. 16.

DESCRIPTION OF THE PREFERRED EMBODIMENT

Figure 3:
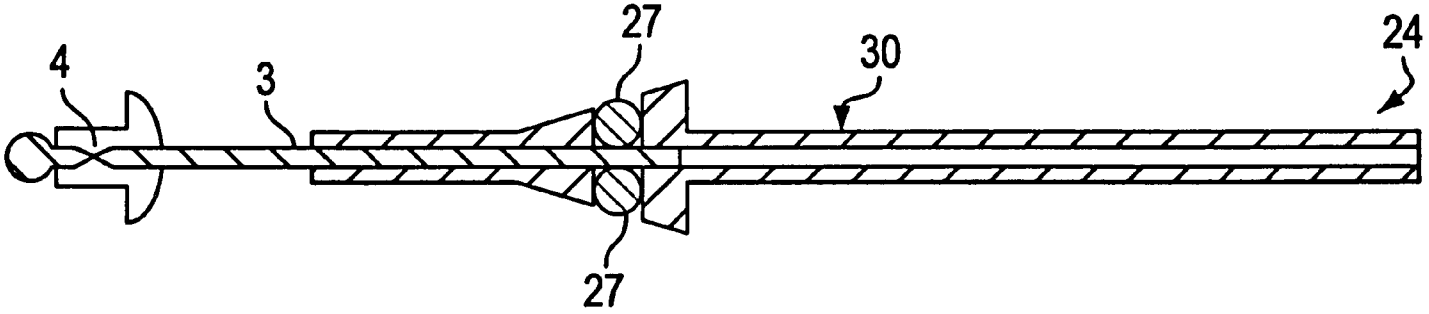
FIG. 3 is a sectional view taken along line 3—3 of FIG. 2.

Referring to the figures, a rivet 1 having a rivet body 2 and a mandrel 3 is set by axially pulling the mandrel through the rivet body to upset the rivet body and so form a counter head. Mandrel 3 is typically provided with a setting head which contacts the rivet body and breakneck or point of weakness 4 (see FIG. 3) located adjacent the setting head where the mandrel will break after the body has been upset during the setting operation. It is important that a rivet setting tool be able to grip the stem of mandrel 3 of rivet 1 with sufficient force to prevent slipping during the setting process. It is also important that the rivet setting tool not cause the mandrel to break at any point other than the predetermined breakneck or point of weakness.

The rivet setting device of the present invention may be mounted in a suitable housing 10 which includes an aperture through which rivet 1 is positioned. Nosepiece 11 provides an anvil against which the head of rivet body 2 is held during the setting operation. Nosepiece 11 also serves to align rivet mandrels of various sizes, as is known in the art.

The rivet setting device of the present invention includes a housing 20 to which an end cap 21 and a taper section 22 are connected at the ends thereof by locking set screws 23. A draw bar 24 is located within the housing. The draw bar has a conical section 25 with ball passages 26 evenly space therethrough. Located within the ball passages 26 are balls 27. The conical section of the draw bar is positioned so that balls 27 cooperate with taper section 22, and also contact mandrel 3. Draw bar 24 also has an axial aperture 28 which extends through the conical section 25. Mandrel 3 fits into this axial aperture where it is contacted by balls 27. A spring 29 is positioned about shaft 30 of draw bar 24. The spring bears upon end cap 21 and the opposing face of conical section 25 and urges the conical section and the balls toward the narrow portion of taper section 22.

Figure 1:
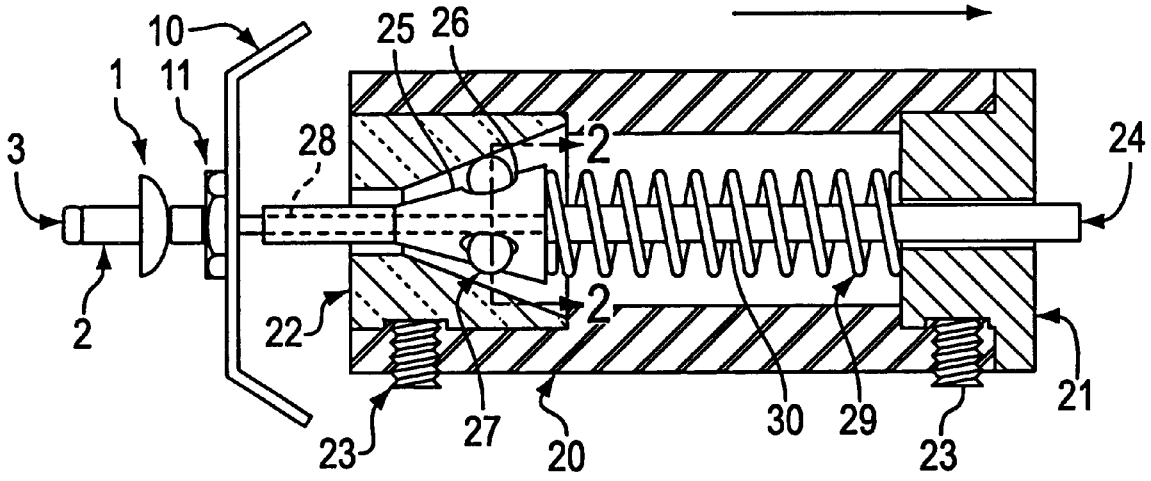
FIG. 1 is a sectional view of an embodiment of a device according to the present invention.
Figure 2:
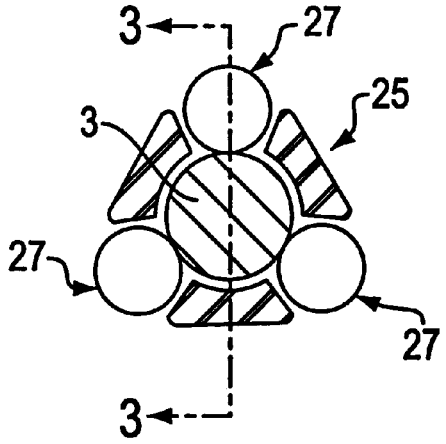
FIG. 2 is a sectional view taken along line 2—2 of FIG. 1.

The operation of the rivet setting device of the present invention will now be explained in greater detail. As mandrel 3 of rivet 1 is inserted into axial aperture 28 of draw bar 24, it is caught and held by balls 27 which are held in place by spring 29. The housing 20 is then pulled in the direction of the arrow shown in FIG. 1, by means of pneumatic, hydraulic or hand, as is known in the art. This motion causes taper section 22 to move in the same direction and causes the balls 27 to roll down the taper and dig into the mandrel. When the balls reach the end of their travel, the rolling motion stops, and the continued pulling motion causes the mandrel to be pulled in the same direction of travel. The pulling of the mandrel causes the rivet body to upset and form a counter head. After such upset, continued pulling causes the mandrel to rupture at the breakneck or point of weakness.

Figure 5:
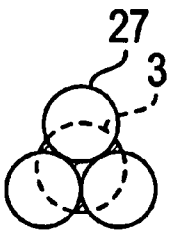
FIG. 5 is a sectional view depicting the balls of a device according to the present invention improperly overcrimping the mandrel of a blind rivet.
Figure 4:
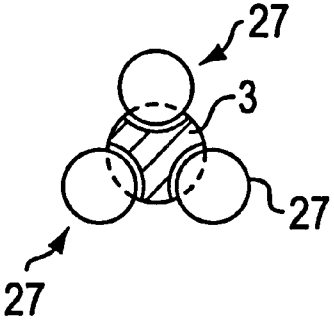
FIG. 4 is a sectional view depicting the balls of a device according to the present invention properly gripping the mandrel of a blind rivet.

It is important that the gripping and pulling device grip the mandrel without slippage and that the mandrel break at the predetermined breakneck. However, in this regard, overcrimping must be avoided. Referring to FIGS. 4 and 5, FIG. 4 depicts balls 27 properly gripping the mandrel 3 of rivet 1 in a normal fashion. With this amount of grip, the balls adequately hold the mandrel without slippage and allow for setting the rivet body and subsequent rupture of the mandrel at the predetermined point of weakness. In other words, the rupture potential at the point of contact between the mandrel and the balls is less than that of the breakneck or point of weakness of the mandrel. This can be measured by the stress concentration. The stress concentration must be less at the point of contact between the balls and the mandrel than at the predetermined point of weakness of the mandrel. FIG. 5 depicts an overcrimping situation. Here, the balls have dug so far into the mandrel that upon application of additional axial pulling force, the mandrel ruptured at the point of contact between the balls and the mandrel instead of at the predetermined point of weakness. In addition, depending on the materials involved, such overcrimping may even result in the breaking of the mandrel before the rivet body has been upset. Recognizing the problems caused by overcrimping, it is important that precautions are taken to minimize it and prevent premature or misplaced rupture of the mandrel. These precautions may take many forms; such as the angle or shape of taper section 22 or the number, position, or shape of balls 27. These will be described in greater detail below.

Figure 6:
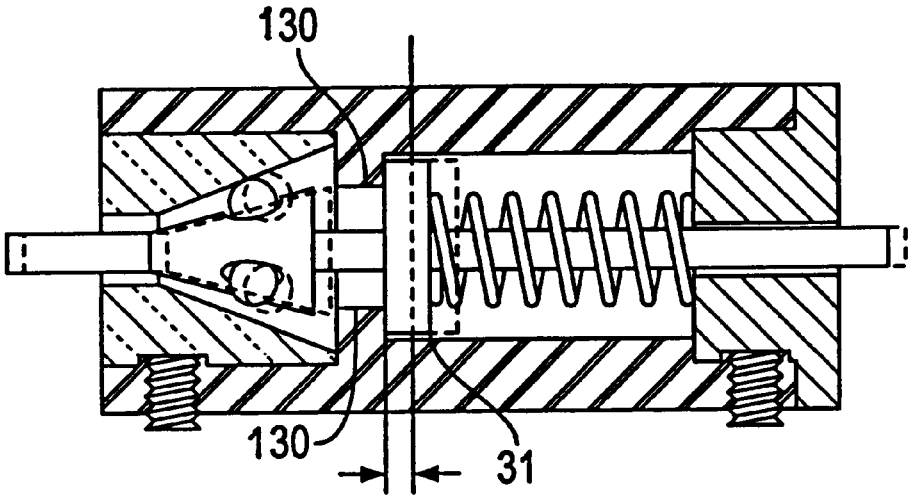
FIG. 6 is a sectional view of another embodiment of a device according to the present invention, featuring a shoulder stop and spacer to prevent overcrimping.

Referring to FIG. 6, overcrimping can be minimized by utilizing shoulder stops 130 located on housing and spacer 31 located on draw bar 24 between conical section 25 and shaft 30. The widths of either the shoulder stop or the spacer can be adjusted, or additional spacer elements can be provided to accommodate different size mandrels. A wider spacer 31, as well as the position of balls, are depicted in phantom in FIG. 6. It is thus clearly shown that the balls start further back on the taper. In addition, shoulder stop 130 cooperates with spacer 31 to limit penetration of the balls, so that the crimp formed by the balls does not exceed the breakneck or crimp preformed in the mandrel. By providing the shoulder and spacer, the balls do not come into the three point contact shown in FIG. 5 and thus do not overcrimp. Spacers of various thicknesses limit the distance the balls are allowed to advance into the taper and decrease the amount of penetration into the mandrel.

Figure 7:
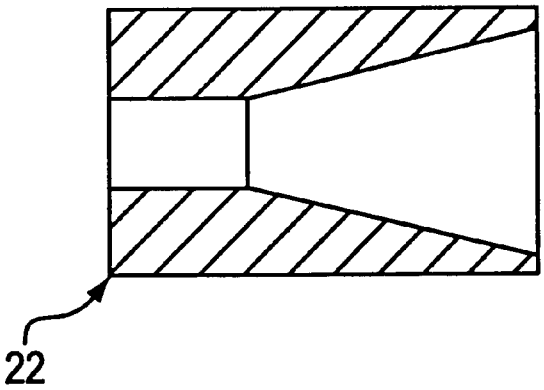
FIGS. 7, 8, and 9 are sectional views of embodiments of taper sections according to the present invention showing various tapers.
Figure 8:
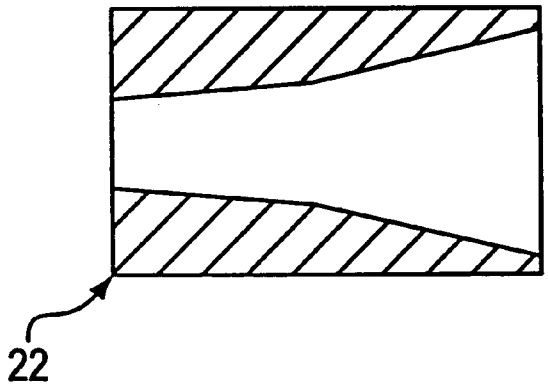
Figure 9:
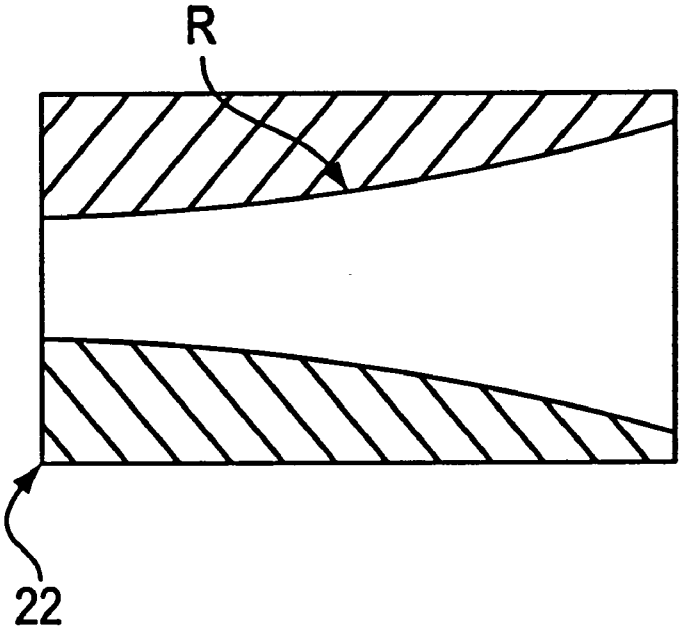
Figure 10:
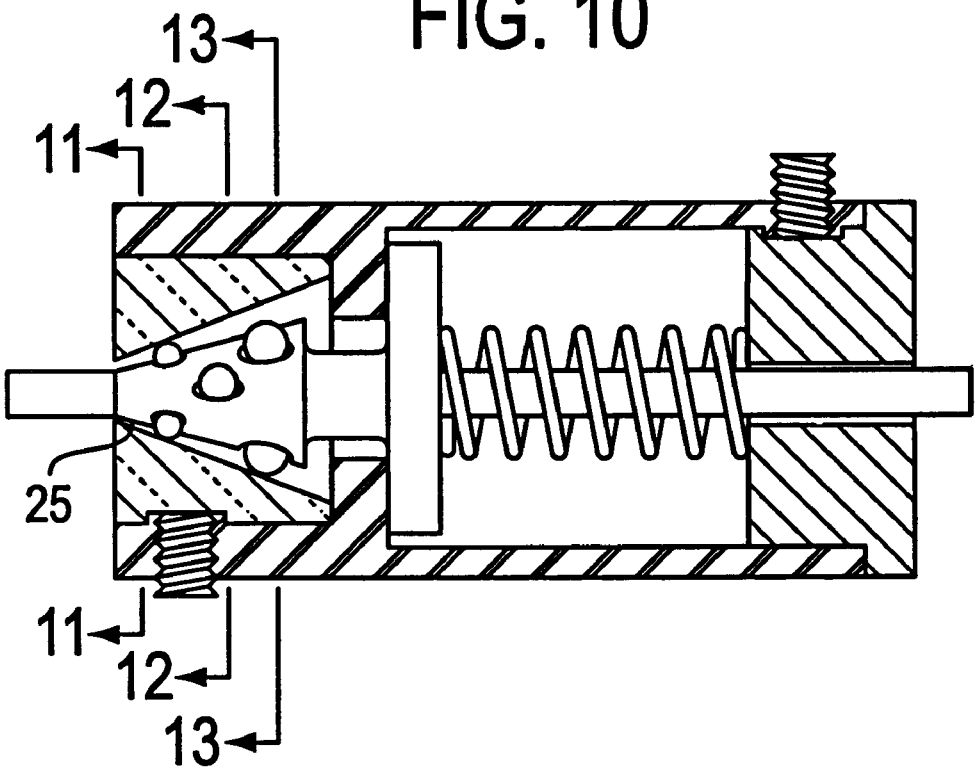
FIGS. 10, 11, 12, and 13 are sectional views of another embodiment a device according to the present invention, featuring balls arranged in multiple rows.

Referring to FIGS. 7, 8, and 9, overcrimping can also be minimized by suitably adjusting the taper of taper section 22. For example, FIG. 7 depicts a constant slope conical taper leading to a constant diameter cylinder. With this arrangement, the taper would be designed to give the proper penetration which would remain constant in the cylindrical portion. FIG. 8 depicts a conical taper of constant slope leading into a conical taper of a lesser included angle or slope. FIG. 9 depicts a taper having a radius instead of the straight conical tapers described in the other figures. It will be appreciated that other variations could also be employed.

The taper must be sized so that the balls of any row are able to grip the desired size mandrel. In this regard, multiple sizes and shapes of taper section may be required to fit various size rivets and mandrels. Also, the taper section should be of a hardness such that the balls will not dig in or deform it upon the setting operation.

Figure 11:
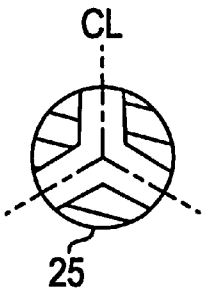
Figure 12:
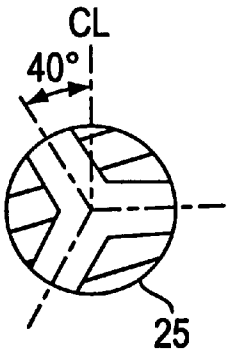
Figure 13:
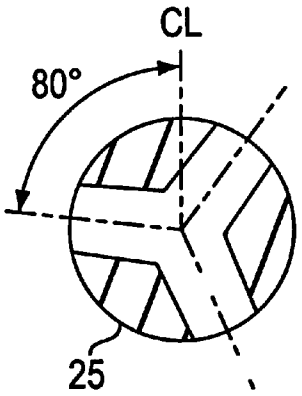

Referring to FIGS. 10 to 13, multiple rows of balls may also be employed. Multiple rows have the advantage of greater gripping ability with less slippage and with less likelihood of overcrimping. Conical section 25 of draw bar 24 is modified to accommodate the multiple rows. As seen in FIGS. 11 to 13, the ball channels are staggered or offset so that no ball is directly in line with another ball. This is so that each ball will have a fresh area to dig into should slippage occur. For gripping and pulling the same size mandrel, balls of increasing size are utilized, with the smallest in the narrowest portion of the taper and progressively increasing in size. Alternately, it may be desirable to provide balls of different sizes to accommodate mandrels of different size, such that one or two rows of balls would grip mandrels of certain sizes, but not other sizes.

Figure 14:
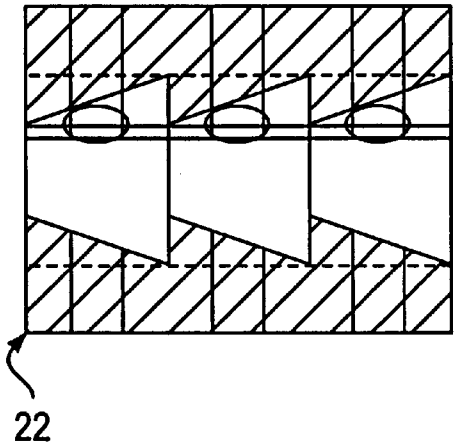
FIG. 14 is a sectional view of another embodiment of a device according to the present invention, featuring multiple tapers utilized with multiple rows of balls.

Referring to FIG. 14, multiple tapers of the same or different included angle may also be utilized with multiple rows of balls of the same diameter for gripping and pulling mandrels of one size and with rows of balls of different diameters for gripping and pulling mandrels off several sizes. It will be appreciated that the taper section depicted in FIG. 14, having multiple tapers, can be produced in two or more sections and assembled together.

Figure 15:
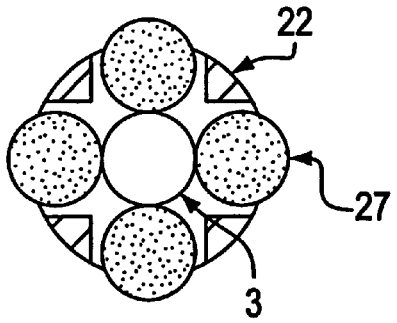
FIG. 15 is a sectional view of a conical section of a draw bar according to the present invention showing passages for a row of four balls.
Figure 16:
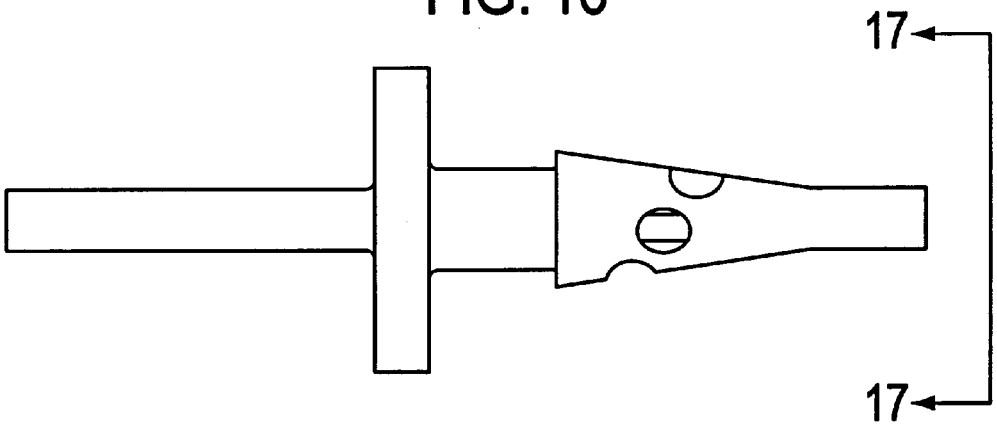
FIGS. 16 and 17 depict a draw bar according to the present invention featuring five balls arranged in a helix.
Figure 17:
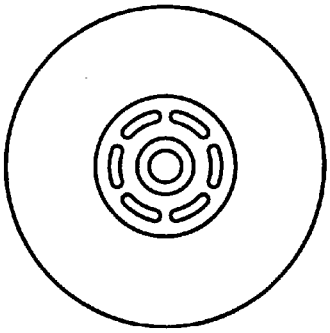

Referring to FIGS. 15, 16, and 17, it will be appreciated that a row of balls can include not only three but also four or more balls, depending on the sizes and the arrangement. FIG. 15 depicts conical section 22 of draw bar 24 having passages for four balls. FIGS. 16 and 17 depict a draw bar having passages arranged in a spiral or helix to accommodate five different sized balls. With these configurations, no ball is in a direct line with another ball.

A multiplicity of balls may be utilized in a multiplicity of rows in the rivet setting device of the present invention. The balls must be sized so that in any row, the balls are able to grip the desired size mandrel. In this regard, the size of the gap between the balls must be compare to the size of the mandrel. If the gap between the balls is larger than the size of the mandrel, no gripping will occur. On the other hand, if the gap between the balls should not be so small that overcrimping can occur. The selection of balls should also be made with a view toward material of the ball and of the mandrel. It is desirable to have a ball which is harder than the mandrel being acted upon so that the ball will not be deformed when it is digging into the mandrel.

Figure 18:
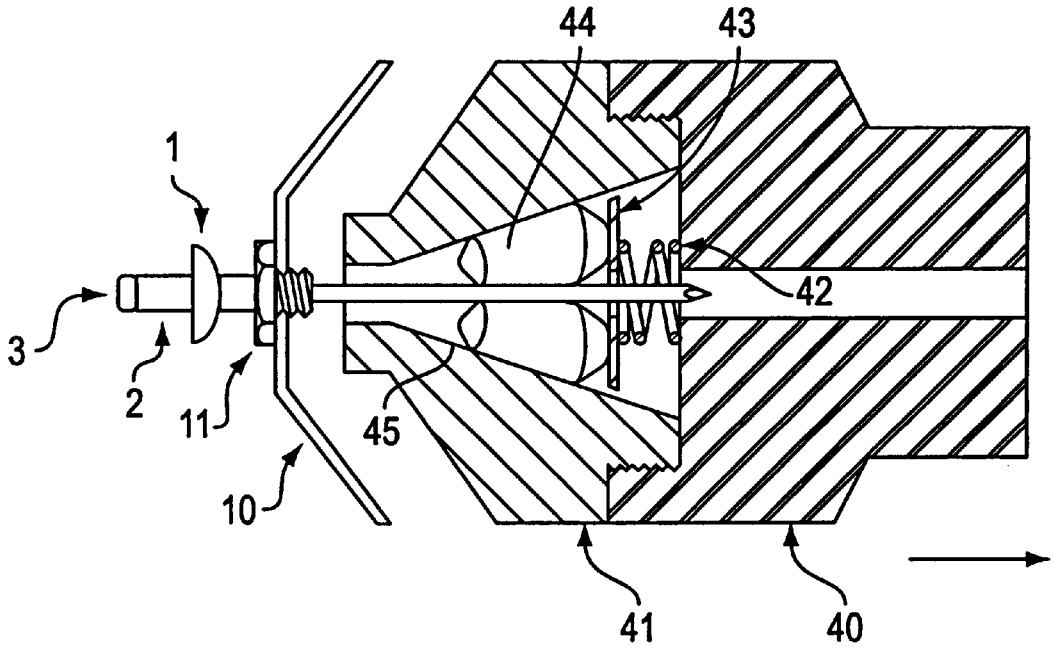
FIG. 18 is a sectional view of another embodiment of a device according to the present invention, featuring pellets instead of spherical balls.

Referring to FIG. 18, it will be appreciated that cylindrical, conical, or other shaped pellets may be utilized instead of spherical balls. In FIG. 18, housing 40 is threadedly engaged to taper section 41. As discussed hereinabove, taper section 41 could have a combination of included angles or a radial section. Spring 42 acts upon spring washer 43 to bias pellets 44 toward nosepiece 10. The operation is as described previously. Briefly, housing 40 is pulled in the direction of the arrow by a pneumatic, hydraulic, or hand operated mechanism, causing pellets to move down the ramp 45 of taper section 41 and dig into mandrel 3 of rivet 1. As pulling continues in the direction of the arrow, rivet body 2 is upset and forms a counterhead. Mandrel 3 is broken off at a predetermined point of weakness or breakneck. Again, it is important that overcrimping be minimized.

Figure 19:
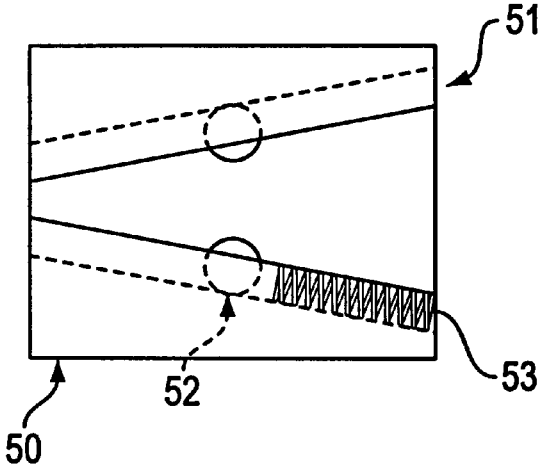
FIGS. 19 and 20 are sectional views of another embodiment of a device according to the present invention, featuring ball channels and balls located in the taper section.
Figure 20:
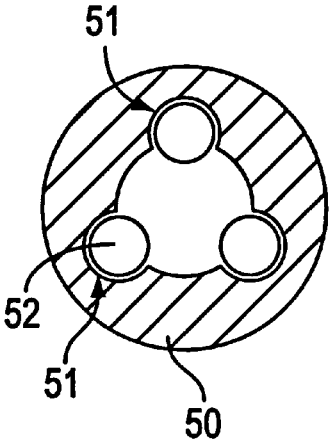

Referring to FIGS. 19 and 20, taper section 50 is provided with ball channels 51 in which balls 52 are located. Springs 53 biases balls 52 toward the narrow portion of the taper, where the balls contact the mandrel for gripping and pulling.

What is claimed is:

1. A riveting apparatus comprising:

a rivet having a head and a body;

a mandrel having a first end and a second end, the first end being in contact with the body of the rivet;

a nosepiece having an aperture, the head of the rivet being positionable to abut the nosepiece and the second end of the mandrel being positionable through the aperture of the nosepiece;

a substantially frusto-conically tapered internal surface coaxially aligned with the aperture of the nosepiece;

a structure having an elongated and substantially hollow first section, the structure further having a second section with a plurality of passages, the structure being axially biased toward the tapered internal surface;

the second end of the mandrel being positionable inside a portion of the structure; and a set of rotatable members located in the passages of the structure, abutting force of the rotatable members against the tapered internal surface operably causing the rotatable members to move toward an axial centerline of the structure and engage corresponding portions of the mandrel, movement of the tapered internal surface and the structure away from the nosepiece and rivet causing breakage of the mandrel at a predetermined location prior to breakage of the mandrel portions corresponding with the rotatable members.

2. The apparatus of claim 1 wherein the rotatable members are substantially circular balls.

3. The apparatus of claim 2 wherein there are multiple rows of the balls axially spaced from each other.

4. The apparatus of claim 2 wherein the balls are transversely and axially offset from each other.

5. The apparatus of claim 1 wherein there are at least nine of the rotatable members.

6. The apparatus of claim 1 wherein at least some of the rotatable members are of different sizes.

7. The apparatus of claim 1 wherein the rotatable members are shaped like pellets.

8. The apparatus of claim 1 further comprising a spring surrounding the first section of the structure, the second section of the structure having a substantially frusto-conically tapered external surface.

9. The apparatus of claim 1 wherein the substantially frusto-conically tapered internal surface has a compound taper of at least two included angles.

10. The apparatus of claim 1 wherein the substantially frusto-conically shaped internal taper has a radial taper.

11. The apparatus of claim 1 further comprising a stop shoulder stationarily mounted relative to the tapered internal surface and a spacer axially movable with the structure, the spacer operably contacting against the stop shoulder to deter overcrimping of the mandrel by the rotatable members.

12. A riveting apparatus comprising:

a nosepiece having an aperture remaining at a fixed size during a rivet setting operation;

a housing axially movable relative to the nosepiece during the rivet setting operation;

a substantially frusto-conically tapered internal surface coaxially aligned with the aperture of the nosepiece, the internal surface being secured to the housing such that the internal surface always moves with the housing during use;

a structure having an elongated and cylindrical first section, the structure further having a substantially frusto-conically tapered external second section with a plurality of passages, the structure being axially biased toward the tapered internal surface; and a set of rotatable members located in the passages of the structure, abutting force of the rotatable members against the tapered internal surface operably causing the rotatable members to move toward an axial centerline of the structure, some of the rotatable members being offset from each other along an advancing and retracting axis.

13. The apparatus of claim 12 wherein the rotatable members are substantially circular balls.

14. The apparatus of claim 13 wherein there are multiple rows of the balls axially spaced from each other.

15. The apparatus of claim 13 wherein the balls are transversely and axially offset from each other.

16. The apparatus of claim 12 wherein there are at least nine of the rotatable members.

17. The apparatus of claim 12 wherein at least some of the rotatable members are of different sizes.

18. The apparatus of claim 12 wherein the rotatable members are shaped like pellets.

19. The apparatus of claim 12 further comprising a spring surrounding an axial majority of the first section of the structure.

20. The apparatus of claim 12 wherein the substantially frusto-conically tapered internal surface has a compound taper of at least two included angles.

21. The apparatus of claim 12 wherein the substantially frusto-conically shaped internal taper has a radial taper.

22. The apparatus of claim 12 further comprising a stop shoulder stationarily mounted relative to the substantially frusto-conically tapered internal surface and a spacer axially movable with the structure, the spacer operably contacting against the stop shoulder to deter transverse movement of the rotatable members too close together.

23. A method of setting a blind rivet with a mandrel using a tool having an internally tapered surface, a draw bar and multiple rotatable members, the method comprising:

(a) engaging the mandrel with the draw bar;

(b) moving the internally tapered surface away from the rivet;

(c) contacting the rotatable members against the internally tapered surface;

(d) contacting the rotatable members against adjacent first portions of the mandrel;

(e) deforming the rivet by the draw bar pulling the mandrel; and (f) severing a second portion of the mandrel prior to severing of the first portions of the mandrel by the rotatable members.

24. The method of claim 23 further comprising biasing the rotatable members against the internally tapered surface even if the mandrel is not engaged with the draw bar.

25. The method of claim 23 further comprising stationarily securing the internally tapered surface to an outer housing of the tool such that the internally tapered surface always moves with the housing during tool operation.

26. The method of claim 23 further comprising moving the internally tapered surface and the draw bar in an exclusively linear direction relative to the rivet.

* * * * *